US008049688B2

(12) United States Patent
Yu et al.

(10) Patent No.: US 8,049,688 B2
(45) Date of Patent: Nov. 1, 2011

(54) APPARATUS AND METHOD FOR CREATING A CROWD-BASED VISUAL DISPLAY WITH PIXELS THAT MOVE INDEPENDENTLY

(75) Inventors: Young Ki Yu, Marrietta, GA (US); Matthew Flagg, Atlanta, GA (US); Suzanne Roshto, Alpharetta, GA (US); Greg Roberts, Alpharetta, GA (US)

(73) Assignee: PlayVision Technologies, Inc., Mountain View, CA (US)

( * ) Notice: Subject to any disclaimer, the term of this patent is extended or adjusted under 35 U.S.C. 154(b) by 1275 days.

(21) Appl. No.: 11/482,245

(22) Filed: Jul. 7, 2006

(65) Prior Publication Data

US 2008/0007498 A1 Jan. 10, 2008

(51) Int. Cl.
*G09G 3/00* (2006.01)
*G09G 3/32* (2006.01)

(52) U.S. Cl. ..... 345/82; 345/31; 345/156; 345/183; 709/227

(58) Field of Classification Search ..... 345/31, 345/156–184; 709/227
See application file for complete search history.

(56) References Cited

U.S. PATENT DOCUMENTS 3,707,055 A * 12/1972 Pearce ..... 446/485
4,282,681 A * 8/1981 McCaslin ..... 446/484
4,810,937 A * 3/1989 Havel ..... 315/152
4,891,032 A * 1/1990 Davis ..... 446/484
4,967,321 A * 10/1990 Cimock ..... 362/101
5,406,300 A * 4/1995 Tokimoto et al. ..... 345/31
5,670,971 A * 9/1997 Tokimoto et al. ..... 345/31
6,016,038 A * 1/2000 Mueller et al. ..... 315/291
6,265,984 B1 * 7/2001 Molinaroli ..... 340/815.4
6,404,409 B1 * 6/2002 Solomon ..... 345/31
6,650,451 B1 * 11/2003 Byers et al. ..... 398/129
6,734,833 B1 * 5/2004 Bartosik ..... 345/4
6,882,117 B1 * 4/2005 Hughes et al. ..... 315/291
7,142,173 B2 * 11/2006 Bentley ..... 345/31
7,352,339 B2 * 4/2008 Morgan et al. ..... 345/31
7,521,872 B2 * 4/2009 Bruning ..... 315/158
2002/0058459 A1 * 5/2002 Holt ..... 446/484
2002/0097471 A1 * 7/2002 Bethea et al. ..... 359/172
2003/0017823 A1 * 1/2003 Mager et al. ..... 455/414
2004/0204240 A1 * 10/2004 Barney ..... 463/36
2005/0040773 A1 2/2005 Lebens et al.
2005/0057919 A1 3/2005 Wong et al.
2005/0093868 A1 * 5/2005 Hinckley ..... 345/502
2006/0007672 A1 1/2006 Benson et al.
2007/0005775 A1 * 1/2007 Philips ..... 709/227
2007/0046625 A1 * 3/2007 Yee ..... 345/156

* cited by examiner

*Primary Examiner* — Amare Mengistu
*Assistant Examiner* — Aaron M Guertin
(74) *Attorney, Agent, or Firm* — Clements Bernard PLLC; Lawrence A. Baratta, Jr.; Christopher L. Bernard

(57) ABSTRACT

The present invention provides a light-emitting apparatus and a method by which a crowd-based display is created wherein each light-emitting apparatus represents one of many independently moving pixels in the crowd-based display. This invention also provides methods, both internal and external to the light-emitting apparatus, by which the visual display sequence is controlled to provide various forms of colorful illumination. This invention discloses a shock wave method, a time-synchronized playback method, and a laser-based actuation method for creating the visual displays of illumination.

11 Claims, 8 Drawing Sheets

APPARATUS AND METHOD FOR CREATING A CROWD-BASED VISUAL DISPLAY WITH PIXELS THAT MOVE INDEPENDENTLY

FIELD OF THE INVENTION

The present invention relates generally to the fields of illumination devices and crowd-based visual displays. More particularly, the present invention relates to a light-emitting apparatus and a method by which a crowd-based visual display is created wherein each light-emitting apparatus comprises one of many independently-moving pixels in the crowd-based display. The present invention also relates to methods by which the visual display sequence of colored lights is controlled to provide various forms and sequences of colorful illumination.

BACKGROUND OF THE INVENTION

Many forms of crowd-unifying entertainment take place at sporting events, concerts, or other like stadium events with large crowds. Such activities include "the wave" phenomenon, flashing colored display cards, and the like. "The wave" refers to a spontaneous, concerted motion of attendees located in a stadium. This concerted motion, "the wave," occurs when persons in one section of the stadium quickly stand up in unison, throwing their arms up into the air, and quickly, in unison, sit back down in their seats. The next adjacent seating section of the stadium, usually in a clockwise circulating direction, then quickly repeats the same collective body action behavior. This collective human behavior continues in one direction around the stadium and may continue for several revolutions around the entire stadium seating area. The effect of this collective human behavior creates the visual appearance of a waveform pattern.

Some stadium events also include colored display cards in each patron's seat. The display card is colored, decorated, or unique in some manner, and is used in concerted motion at a particular point, such as a sporting event halftime show, or an opening ceremony, to provide a crowd-based visual display, visible from great distances. This display, through the use of differing colors amongst the cardholders, presents some visually pleasing image to views on the opposite side of the stadium or to a television audience, for example, such as from an airplane, helicopter, blimp, or the like.

Both "the wave" and the use of colored display cards are visible from great distances. Whether viewers in an aircraft or viewers at opposite ends of a stadium, all should be able to observe the crowd-based display. Such events or activities are provided, or spontaneously happen, to entertain both participants and observers in a context that only large groups of people in a stadium seating arrangement can provide.

Unfortunately, these traditional crowd-based displays suffer from a number of deficiencies. For example, such displays are usually static in terms of content. During "the wave," in which a person is either seated or standing, the person remains in the same seat location within the stadium. During a display card stadium event, a display card is either visibly shown or stowed under the stadium seat. The participant does not walk about freely in the stadium holding the display card. Additionally, an event such as "the wave" occurs only a few times during an event, and the display card exercise usually occurs only once, such as at a sporting event halftime show or an opening ceremony.

It is therefore desirable to have an apparatus and method by which crowd-based displays are created, wherein a stationary or mobile patron's hand-held light-emitting apparatus comprises one of many independently-moving pixels in the display. Furthermore, it is desirable to have methods and control sources by which the display sequence of colored lights is controlled.

Known in the art are devices that incorporate the use of LEDs, or light-emitting diodes, in their construction to provide a hand-held colorful light display. An LED is a semiconductor device that emits incoherent narrow-spectrum light. Known LED products in the marketplace that provide a hand-held colorful light display include a spinner ball LED wand (http://www.clubthings.com/product1069.html), a laser pointer and multi-color LED wand (http://www.yoyostore.com/laspoinmulco.html), an LED message wand to display any one of eight pre-programmed or custom light up messages (http://www.lightgod.com/store/product.asp?catid=1&subcatid=962&id=3608), a lighted LED wand, comprised of a multi-color nine-inch lighted flashing wand, (http://www.windycitynovelties.com/EPaysoft/Cart/product.asp?ITEM_ID=7372&CatID=0), and a strober wand (http://www.technomoves.com/strober.html).

Patent applications known in the art that include the use of LEDs for colorful visual displays or that include LEDs in a hand-held device, such as a flashlight or medical instrument include, for example, U.S. Patent Application Publication No. 2006/0007672, filed by Benson et al. and published on Jan. 12, 2006, disclosing a user-wearable LED display. A user wearable display apparatus contains a light source that emits light and is positioned so as to illuminate a design on the surface of the display apparatus and attract viewers. The display apparatus also contains a power supply that provides power to the light source.

U.S. Patent Application Publication No. 2005/0040773, filed by Lebens et al. on Feb. 24, 2005, discloses a method and apparatus for hand-held portable LED illumination. The illumination source includes a plurality of LEDs, and an electrical circuit that selectively applies power from the DC voltage source to the LED units, wherein the illumination source is suitable for hand-held portable operation. In some embodiments, the electrical circuit further includes a control circuit for changing a proportion of light output having the first characteristic color spectrum output to that having the second characteristic color spectrum output, and that drives the LEDs with electrical pulses at a frequency high enough that light produced has an appearance to a human user of being continuous rather than pulsed. Still another aspect provides an illumination source including a housing including one or more LEDs; and a control circuit that selectively applies power from a source of electric power to the LEDs, thus controlling a light output color spectrum of the LEDs.

U.S. Patent Application Publication No. 2005/0057919, filed by Wong et al. on Mar. 17, 2005, discloses a method and apparatus for illuminating lighting elements in one or more predetermined patterns. A preferred frequency controlled lighting system implementing this method includes a motion switch, a controller, and lighting elements. The motion switch creates an activation signal in response to movement of the motion switch, the activation signal indicating at least one of duration of electrical engagement or frequency of electrical engagement within the motion switch. The controller detects the activation signal generation and uses a signal analysis system to analyze the activation signal. Preferably, a short signal circuit within the signal analysis system detects when the duration of electrical engagement is less than or equal to a predetermined duration level, a long duration circuit within the signal analysis system detects when the duration of electrical engagement is greater than the predetermined duration level, and a fast frequency circuit detects when the frequency of electrical engagement is greater than a predetermined frequency threshold. In response to properties of the activation signal, the signal analysis system commands a pattern generator to illuminate the lighting elements in one or more predetermined patterns.

While these and other devices and methods have attempted to solve the above mentioned problems, none have provided for a light-emitting apparatus and a method by which a crowd-based display is created wherein each light-emitting apparatus comprises one of many independently-moving pixels in the crowd-based display. Therefore, a need exists for such a device and associated methods of manufacture and use.

BRIEF SUMMARY OF THE INVENTION

In various embodiments, the present invention provides a light-emitting apparatus and a method by which a crowd-based display is created wherein each light-emitting apparatus comprises one of many independently-moving pixels in the crowd-based display. In various embodiments, the invention also provides methods by which the display sequence of colored lights is controlled to provide various forms of illumination.

In one exemplary embodiment of the present invention, a hand-held light-emitting wand, an LED wand, for illuminating a display sequence of colored lights from one or more control sources is disclosed. The light-emitting wand includes a blue high-intensity LED, a red high-intensity LED, a green high-intensity LED, an infrared high-intensity LED, an LED control source for controlling the display sequence of colored lights, a microprocessor, an infrared receiver, a diffuser, and a power source. A "wand" refers generally to a device or apparatus having any suitable shape and/or dimensions such that it may be held in the hand of or otherwise attached to an individual.

In another exemplary embodiment of the present invention, the LED wand includes a shock sensor for triggering communication between two LED wands and shock waves provide the control means for controlling how the visual display is generated. As two or more LED wands are tapped together, the action is detected by the on-board shock sensor and various data streams are then transmitted between the LED wands to produce various illumination patterns. This is a shock wave method for creating visual displays.

In yet another exemplary embodiment of the present invention, the hand-held LED wand serves as, or represents, a pixel, or display element, that is part of a crowd-based display composed of many LED wands. It is well known in the art that a pixel, or picture element, is a unit of resolution for visual display having a single point in a grid, a color, and a brightness value. For example, an image with a 1280×1024 resolution has 1280 pixels horizontally and 1024 pixels vertically. This concept can be scaled significantly larger to realize that an individual person in a stadium holding an LED wand represents an individual pixel in a very large visual display. From a distance, the synchronized displays from the LED wands create the illusion of a single visual display. Most visual displays are composed of a set of pixels or display elements whose positions are fixed in space with respect to other pixels; the display may move but the physical relationship of each pixel will stay the same. The unique feature of the LED wand-based visual display, however, is that each pixel or display element is physically moving independently from the other pixels. This difference not only makes the display unique in terms of how it functions, but also in how it appears to viewers. The LED wand display has an eye-pleasing effect due to the random motion of each pixel.

In yet another exemplary embodiment of the present invention, the control source includes of an on-board memory storing an entire display sequence. An individual LED wand is synchronized to other LED wands by starting playback of the display sequence at a specific, common point in time. This is a time-synchronized playback method for creating visual displays.

In yet another exemplary embodiment of the present invention, the control source is external to an LED wand. This includes a method for laser-based actuation including a laser galvanometer for LED wand control. In a manner similar to a CRT (cathode ray tube) display, an infrared laser or projector transmits control data from a digital control computer to a large area covering hundreds or possibly thousands of LED wands. By scanning the display area repeatedly and rapidly, dynamic display content is sent to pixel locations in the area. The function offered by this system is that the pixels or LED wands need not remain in a static location as do traditional pixels in a visual display. Rather, the persons holding the LED wands may move around independently and still receive and display the "correct" color, or color that is intended for the stadium zone of the display they are positioned in at any point in time. Not only does this provide a technical advantage of large scale displays, it offers an artistic difference that may give the large display an organic or random nature to it. Despite movement of all pixels, a clear image may always be resolved by a viewer at a distance, such as a person in an aircraft or on the opposite facing side of a stadium. This is the laser-based actuation or laser galvanometer method for creating visual displays.

A plurality of light-emitting wands are used to provide a dynamic crowd-based display in which each person represents a pixel in a large visual display and where each person can freely move about while holding a light-emitting wand. Such a visual display is more pleasing to the eyes than a mere static display of flashing display cards or the like. Such a visual display also enables interactive applications unlike previous non-interactive approaches and offers a wider range of functionality including peer-to-peer interaction, interaction with infrared-based interactive applications such as the playmotion!™ by Greg Roberts experience (as disclosed in U.S. Provisional Patent Application No. 60/700,827, Sensory Integration Therapy System and Associated Method of Use, filed Jul. 20, 2005) and may be reused across a number of events.

There has thus been outlined, rather broadly, the features of the present invention in order that the detailed description that follows may be better understood, and in order that the present contribution to the art may be better appreciated. There are additional features of the invention that will be described and which will form the subject matter of the claims. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Additional objects and advantages of the present invention will be apparent from the following detailed description of an exemplary embodiment which is illustrated in the accompanying drawings.

BRIEF DESCRIPTION OF THE DRAWINGS

The present invention is illustrated and described herein with reference to various drawings, in which like reference numerals denote like apparatus components and/or method steps, and in which.

DETAILED DESCRIPTION OF THE INVENTION

Before describing the disclosed embodiments of the present invention in detail, it is to be understood that the invention is not limited in its application to the details of the particular arrangement shown since the invention is capable of other embodiments. Also, the terminology used herein is for the purpose of description and not of limitation.

Figure 1:
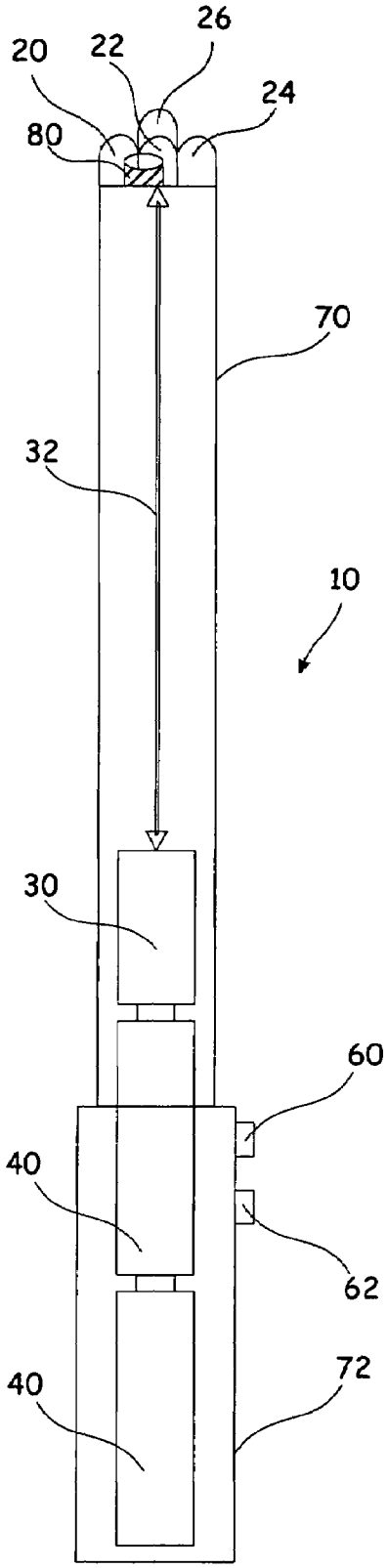
FIG. 1 is a front planar view of an LED wand according to an embodiment of the present invention.

Referring now to FIG. 1, a front planar view of a light-emitting wand, or LED wand, 10 is shown. The LED wand 10 is a small hand-held electronic device that is capable of displaying both colored visible light and near-infrared light. The main function of an LED wand 10 is to display a sequence of colors as part of a visual display composed of a collection of LED wands 10. The display sequence is controlled from one of several control sources. The LED wand has any suitable shape and/or dimensions such that it may be held in the hand of or otherwise attached to an individual. The LED wand is made of any suitable material such as plastic, metal, or the like.

The light-emitting wand includes a blue high-intensity LED 20, a red high-intensity LED 22, a green high-intensity LED 24, an infrared high-intensity LED 26, an LED control source for controlling the display sequence of colored lights, as referred to in more detail hereinbelow, a microprocessor 30, an infrared receiver 80, and a power source 40. In FIG. 1, the LEDs 20, 22, 24, and 26 are shown exposed, without a diffuser covering them. However, a diffuser is used to cover the various radiation sources, light-emitting sources, LEDs, or the like, as illustrated in later figures.

The physical assembly of the LED wand 10 components is maintained in a protective shell 70 and a handgrip 72. In FIG. 1, the LED wand 10 is hand-held; however, the LED wand 10 includes other means than hand-held and attaches by other means to an individual or location. The LED wand 10 further includes two finger-activated push buttons within the physical assembly of the LED wand 10: a power ON/OFF button 60, and a mode selection button 62. Within the physical assembly of the LED wand 10, wire connector means 32 are used to connect the microprocessor 30, various LEDs 20, 22, 24, and 26, and a printed circuit board. The wire connector means 32 include electronic wiring and/or a printed circuit board.

The LEDs 20, 22, 24, and 26 are all products known in the art and easily obtained through various microelectronic sales outlets. Although FIG. 1 illustrates the use of one blue high-intensity LED 20, one red high-intensity LED 22, and one green high-intensity LED 24, various quantities and configurations of LEDs may be used to produce various colors. It is well known in the art that selections from a plethora of color LED components and combinations could be used. Shown here in FIG. 1 is a simple example of LED combinations.

Using the three color LED components as shown, there are eight possible color combinations that may be illuminated from the LED wand 10. Since each colored LED 20, 22, 24 may be either ON or OFF, and since there are three colors, blue, red, and green, for the LEDs shown, there are eight possible color combinations. For example, if the blue high-intensity LED 20 if OFF, but the red high-intensity LED 22, and green high-intensity LED 24 are ON, the resultant color is the combination of equal parts of red and green emitted light.

The LED control source for controlling the display sequence of colored lights may be one of several options. For example, the LED control source may be on-board the LED wand 10 printed circuit board or it may be external to the LED wand. One on-board LED control source option includes an on-board memory which is used in the time-synchronized playback method for creating the visual displays. Another on-board LED control source option includes an on-board shock sensor which is used in the shock wave method for creating visual displays (shown in FIG. 8). An external LED control source method is the laser-based actuation method, using a bean scanning galvanometer, for creating the visual displays (shown in FIG. 4).

In the time-synchronized playback method, the LED control source is comprised of an on-board memory, located within the LED wand 10, storing an entire visual display sequence. Also included in the on-board memory is an information instruction set including time and display sequence information. An individual LED wand 10 is synchronized to other LED wands 10 by starting playback of the display sequence at a specific, common point in time. For example, to create a crowd-based display at a certain point in time at a stadium event and with various display sequences generated at the LED wands 10, the on-board memory is pre-programmed such that the various LED wands 10 in use in various stadium seating sections are synchronized on time and content for generating a crowd-based visual display. Instruction sets contained within the on-board memory can vary between the plurality of seating sections and individual seats within a stadium.

Figure 2:
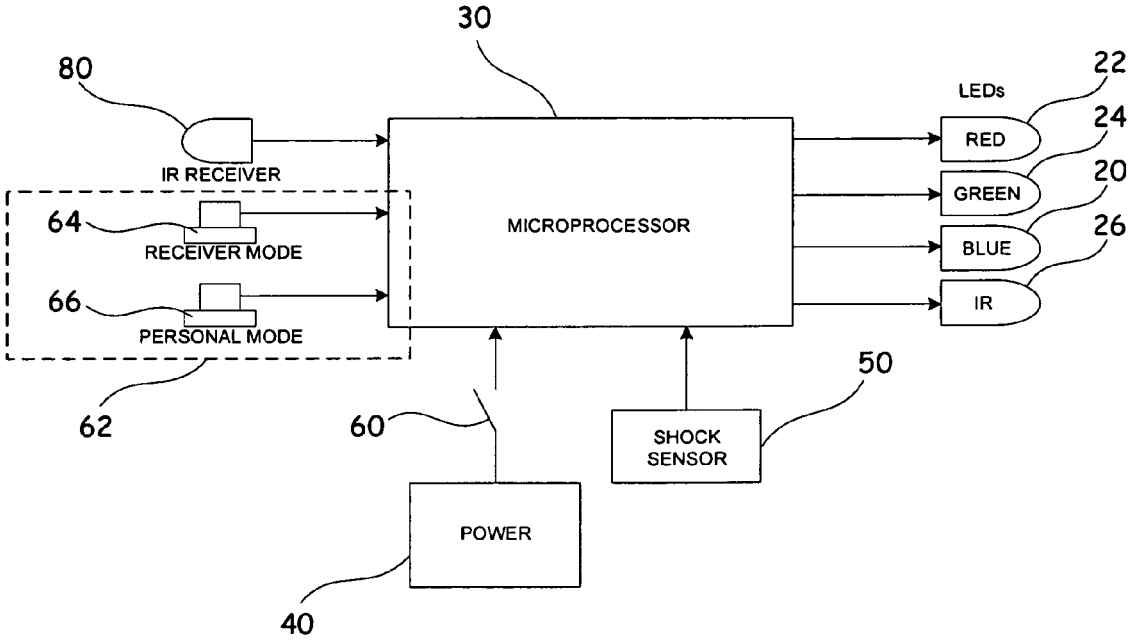
FIG. 2 is a circuit diagram of an LED wand according to an embodiment of the present invention.

Referring now to FIG. 2, an electronic component circuit diagram for an LED wand 10 is shown. The circuit diagram is representative of how the various electronic components within the LED wand 10 relate and how they are manufactured together on a printed circuit board. The microprocessor 30 is connected to the red, green, blue, and infrared LEDs 22, 24, 20, 26, respectively. A shock sensor 50 is included for detection of shock waves 52 from interaction between multiple LED wands 10. The LED wand 10 may operate in either a personal mode 66 or a receiver mode 64, as determined by user input at the mode selection switch 62. The personal mode 66 is for use as a stand-alone LED wand. While in receiver mode 64, the LED wand receives, through the IR receiver 80, infrared signals from external sources such as from the laser-based actuation, or laser galvanometer, method. The circuit diagram is also shown with a power source 40. The power source 40 includes direct current batteries, but other power sources of varying types such as rechargeable batteries, fuel cells, or the like, may be used. The power source 40 is initiated by a user depressing the ON/OFF switch 60.

Figure 3:
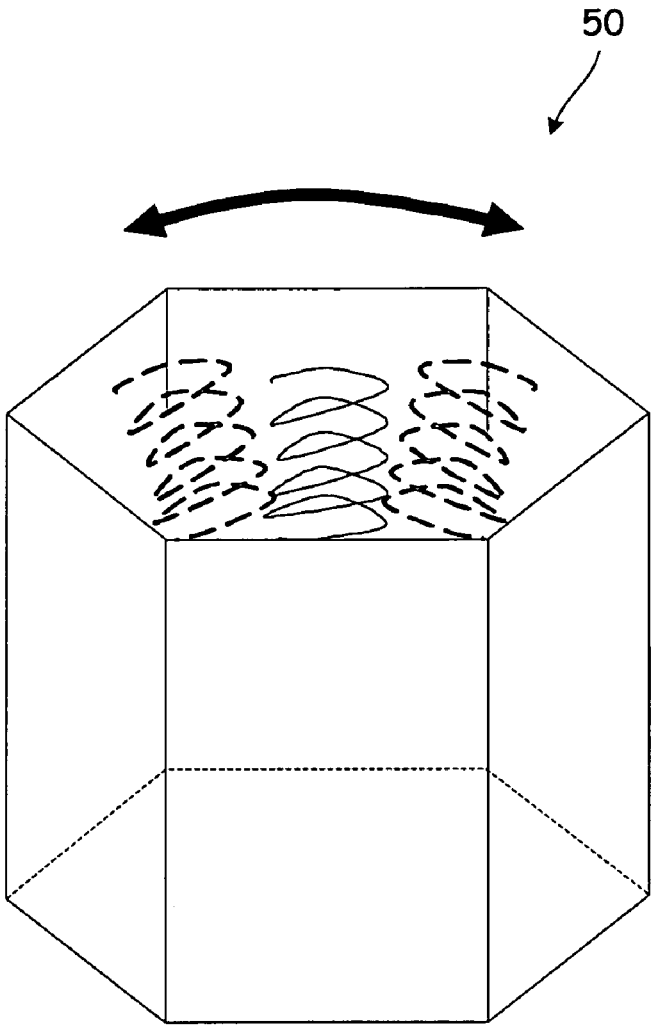
FIG. 3 is a front perspective view of an LED wand shock sensor according to an embodiment of the present invention.

Referring now to FIG. 3, a front perspective view of an LED wand shock sensor 50 is shown. A shock sensor 50 is well known in the art and is easily obtained through various microelectronic sales outlets. Once an LED wand 10 is moved, hit, or jostled in any manner, the shock sensor 50 recognizes, or senses, the shock waves 52 and the varying intensity of the shock waves 52. The shock sensor 50 is then capable of transmitting a signal with the detected shock waves 52.

Figure 8:
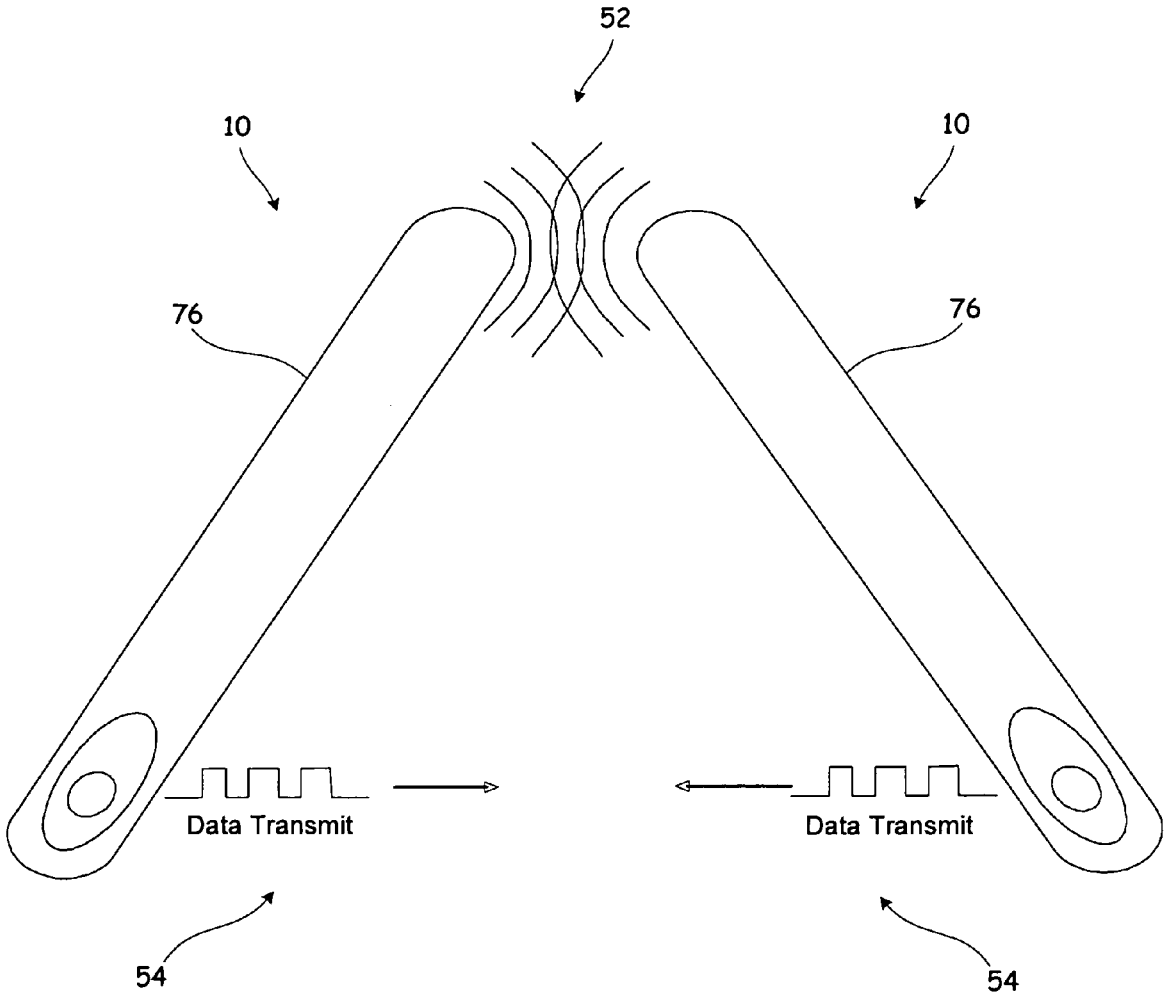
FIG. 8 is a front planar view illustrating two LED wands interacting, sensing shock, and transmitting data according to an embodiment of the present invention

In embodiments where the LED wand 10 also includes a shock sensor 50, such as in the shock wave method for creating visual displays, the shock sensor 50, once activated, triggers communication between two or more LED wands 10. As two or more LED wands 10 are tapped together, or otherwise moved, hit, or jostled, the action is detected by the on-board shock sensor 50 and various data streams 54, as shown for example in FIG. 8, are then transmitted between the LED wands 10 to produce various illumination patterns. For example, where two persons are in proximity of one another and each holding an LED wand 10, one taps the LED wand 10 of the other. The tapping is sensed by the shock sensor 50 on-board each of the two LED wands 10. As a result of the shock sensor 50 sensing the shock waves (as shown in FIG. 8), a visual display sequence is generated from the microprocessor and the visual display sequence is transmitted electronically from the microprocessor to the various LEDs. The visual display sequence information is also transmitted from the high-intensity infrared LED 26 of one LED wand 10 to the other LED wand 10. Thus, an eye-pleasing visual display is generated from each LED wand 10 after one LED wand 10 has tapped the other LED wand 10 and each has sensed shock as detected by the on-board shock sensor 50.

Figure 4:
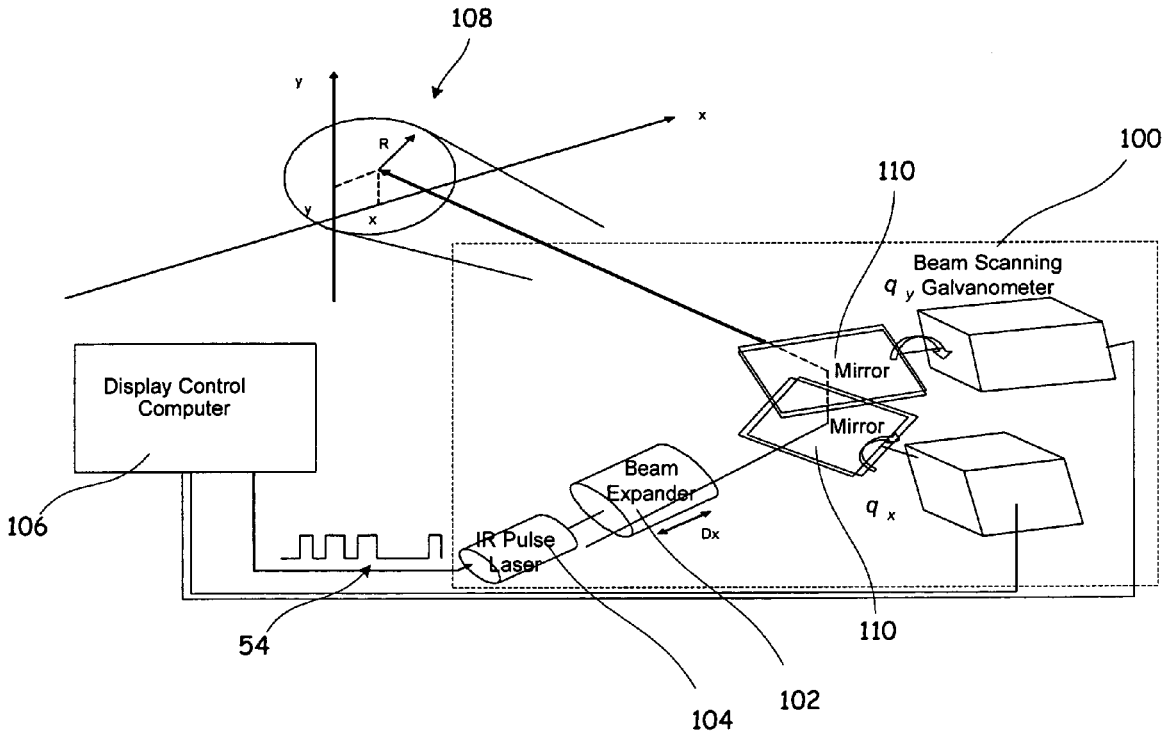
FIG. 4 is a schematic diagram illustrating the interaction between a plurality of LED wands and an external means of controlling the display sequence in each according to an embodiment of the present invention.

Referring now to FIG. 4, a schematic diagram illustrating the interaction between a plurality of LED wands 10 and an external (to the LED wand 10) means of controlling the display sequence in each is shown. The external LED control source method shown is the laser-based actuation, or laser galvanometer, method wherein the LED wand 10 and a beam scanning galvanometer 100 interact, creating colorful visual displays. Also shown are the IR pulse laser 104, a beam expander 102, and the mirrors 110 of the beam scanning galvanometer 100. A beam scanning galvanometer 100 is well known in the art and may be obtained through various microelectronic sales outlets. A beam scanning galvanometer 100 may have varying mirror 100 sizes and combinations and may operate at varying speeds of scanning. The digital control computer 106 acts as a source of video display content by transmitting a signal to a control board attached to a beam scanning galvanometer 100. This control board attached to a beam scanning galvanometer 100 translates the video signal, or abstraction of the signal, to an intermediate signal that drives the beam scanning galvanometer 100. The beam scanning galvanometer 100 directs the laser beam, and the IR pulse laser 104 is pulse-modulated (binary switching) according to a communications protocol that is custom designed for transmitting to the LED wands 10. This infrared protocol is based on a common transmission protocol used for remote controlling televisions and VCRs. The LED wand 10, which is represented as a reference point in the crowd 108, composed of various x,y coordinates to pinpoint an exact location, receives the signal by means of its IR receiver 80 and the microprocessor 30 processes the signal to control the LEDs, 20, 22, and 24, as shown in previous figures. Additionally, as shown in previous figures, the infrared LED 26 in an LED wand 10 is capable of transmitting display information to neighboring LED wands 10 so a display may be propagated across a crowd through peer to peer communication alone.

For example, where many persons are located throughout a stadium or the like, and as recognized by the beam scanning galvanometer 100 as a reference point in the crowd 108, and each holding or having an LED wand, multiple beam scanning galvanometers 100 scan the crowd. The digital control computer 106 acts as a source of video display content by transmitting a signal to a control board attached to a predetermined number of beam scanning galvanometers 100. Each beam scanning galvanometer 100 scans an area of a stadium and sends various visual display sequences, or data streams 54, to each reference point in the crowd 108. This is done by the X-Y scanning capabilities of the beam scanning galvanometer 100.

The laser actuation method of creating visual displays exploits people's persistence of vision, or ability to hold a color in place for a short but delayed amount of time. By scanning an IR pulse laser 104 quickly enough, the IR pulse laser 104 may create the illusion of a complete drawing or set of contours. This invention exploits this property of temporal dithering afforded by galvanometer-controlled lasers to rapidly transmit independent signals to large areas for controlling the color of a LED Wand that may or may not be in an expected region of the display.

Figure 5:
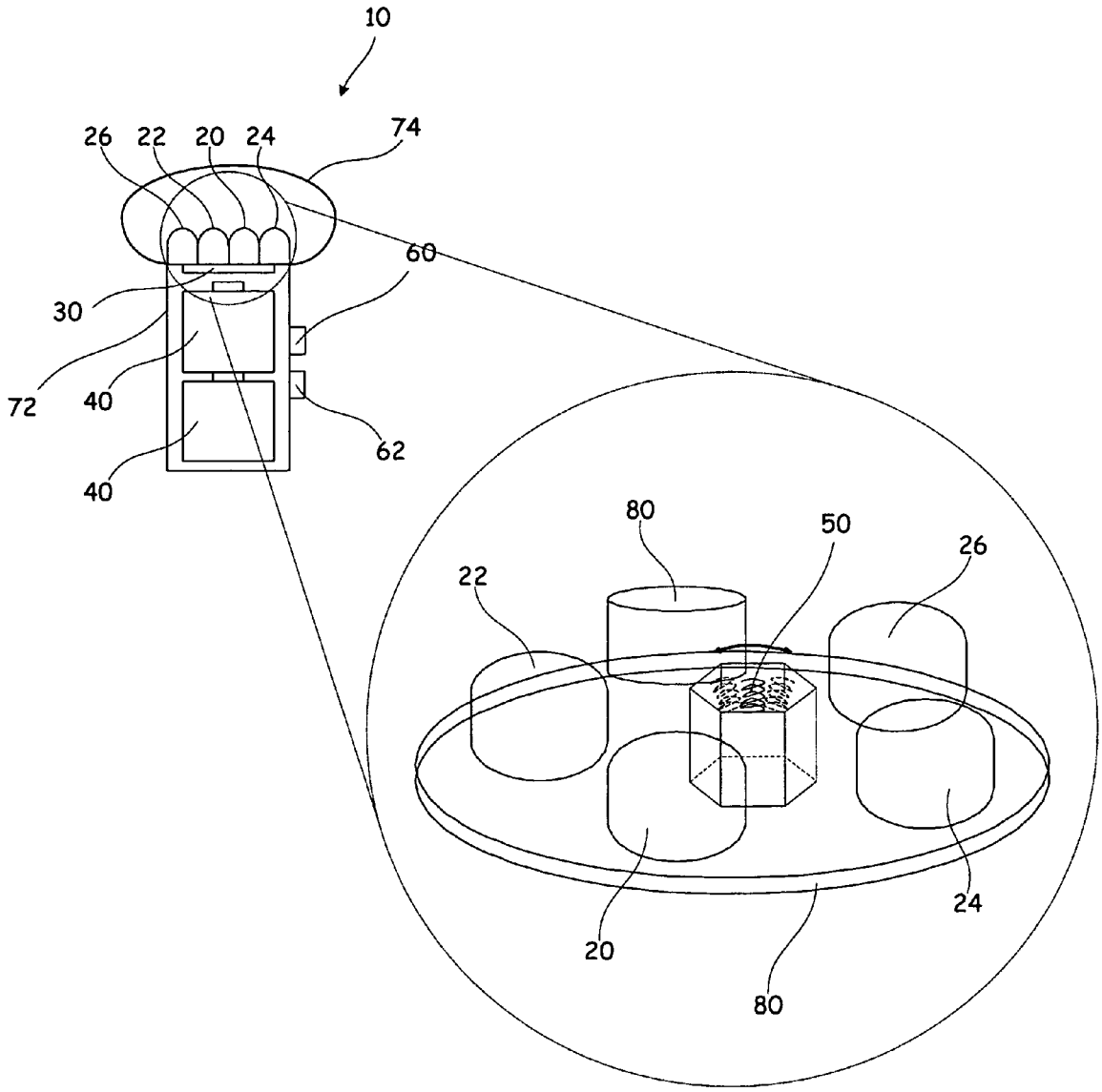
FIG. 5 is a front perspective view of an LED wand, diffuser, and shock sensor according to an embodiment of the present invention.

Referring now to FIG. 5, a front perspective view of an LED wand 10, spherical diffuser 74, and shock sensor 50 is shown. The LED wand 10 is shown with blue, red, and green high-intensity LEDs 20, 22, 24 and an infrared high-intensity LED 26. The LED wand 10 is also shown with the microprocessor 30, hand grip 72, power source, 40, power ON/OFF button 60, and a mode selection button 62. The enlarged area view is also shown with a shock sensor 50 and an IR receiver 80.

A diffuser (a spherical diffuser 74 in FIG. 5 and a cylindrical diffuser 76 in FIGS. 6, 7, and 8) is a device used to scatter the light rays 28 from the LED sources 20, 22, 24, and 26 by the process of diffuse transmission, or light scattering. A diffuser 74 or 76 is generally made of a translucent material. The diffuser 74 or 76 also serves as a protective shell or cover over the LED components 20, 22, 24, and 26. Various diffusers 74 or 76 in size, shape, and of varying degrees of translucency, all of which are well known in the art, may be used for the LED wand 10.

Figure 6:
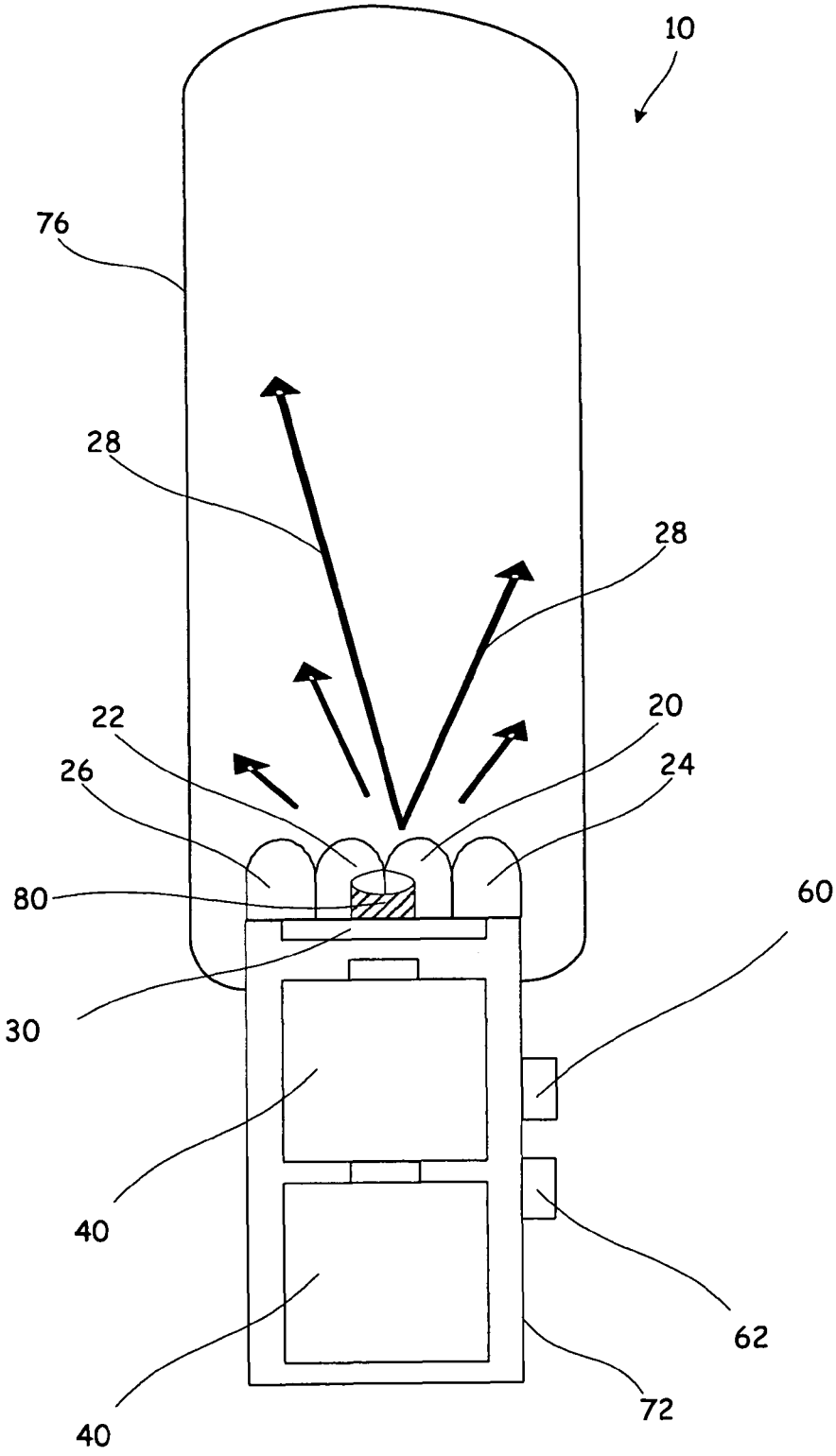
FIG. 6 is a front planar view of an LED wand according to an embodiment of the present invention.

Referring now to FIG. 6, a front planar view of an LED wand 10 is shown. This LED wand 10 is illustrated with a cylindrical diffuser 76. The LED wand 10 is shown with blue, red, and green high-intensity LEDs 20, 22, 24, an infrared high-intensity LED 26, and an infrared receiver 80. Light rays 28 from either visible color light or from infrared light are emitted from the various LEDs, 20, 22, 24, and 26. The LED wand 10 is also shown with the microprocessor 30, hand grip 72, power source 40, power ON/OFF button 60, and a mode selection button 62.

Figure 7:
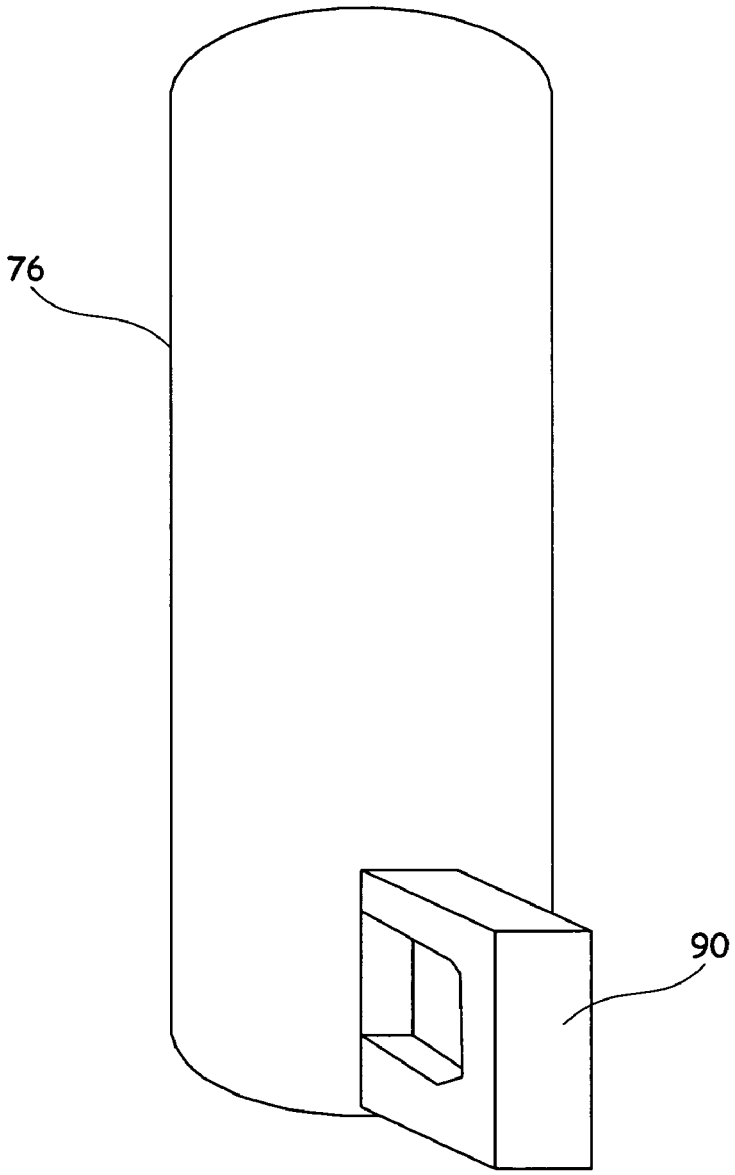
FIG. 7 is a front perspective view of an LED wand cylindrical diffuser and replaceable LED cartridge according to an embodiment of the present invention.

Referring now to FIG. 7, a front perspective view of an LED wand cylindrical diffuser 76 and replaceable LED cartridge 90 is shown. The color or infrared LEDs may eventually burn out and no longer emit light. Thus, the LED wand 10 provides a mechanism for easy replacement of the LEDs 20, 22, 24, and 26. As shown, a replaceable LED cartridge 90, containing the various LEDs, 20, 22, 24, and 26 may be inserted into the LED wand 10 when necessary.

Referring now to FIG. 8, a front planar view of two LED wands 10 interacting, sensing shock, and transmitting data is shown. This is the shock wave method for creating colorful visual displays, wherein physical touch, or shock, between two or more LED wands 10 may be detected using the on-board shock sensor 50 in each LED wand 10 to transmit visual display information in the form of data streams 54.

For example, as two or more LED wands 10 are tapped together, or otherwise moved, hit, or jostled, the action is detected by the on-board shock sensor 50 in each LED wand 10 and various data streams 54 are then transmitted between the LED wands 10 to produce various illumination patterns by instructions from the microprocessor 30 and transmitted through the high-intensity infrared LED 26, as shown in earlier figures. Where two persons are in proximity of one another and, one taps the LED wand 10 of the other. The tapping is sensed by the shock sensor 50 on-board each of the two LED wands 10. As a result of the shock sensor 50 sensing the shock waves, a visual display sequence is generated from the microprocessor and the visual display sequence is transmitted electronically from the microprocessor to the various LEDs. The visual display sequence information is also transmitted from the high-intensity infrared LED 26 of one LED wand 10 to the other LED wand 10. Thus, an eye-pleasing visual display is generated from each LED wand 10 after one LED wand 10 has tapped the other LED wand 10 and each has sensed shock as detected by the on-board shock sensor 50.

A preferred mode of practicing the invention is in large stadiums during sporting events, concerts, or the like. Traditionally, such crowd-based displays are concerted efforts of a crowd requiring the bearing of cards or colors in unison. The LED wand 10 based display of the represent invention, however, may be used anytime during the event as long as they are visible. In such crowd-based displays, the hand-held LED wand 10 serves as, or represents, a pixel, or display element that is part of a large crowd-based display composed of many LED wands 10.

A preferred mode is further comprised of a method for laser-based actuation comprised of a beam scanning galvanometer 100 for LED wand 10 control. In a manner similar to a CRT (cathode ray tube) display, an infrared pulse laser 104 transmits control data streams 54 from a digital control computer 106 to a large area covering hundreds or thousands of LED wands 10. By scanning the display area repeatedly and rapidly, thus determining a reference point in the crowd 108, dynamic display content may be sent to pixel locations in the area. The LED wands 10 need not remain in a static location, such as at one stadium seat number, as do traditional pixels in a visual display. Rather, the persons holding the LED wands 10 may move around independently and still receive and display the "correct" color, or color that is intended for the stadium zone of the display they are positioned in at any point in time. This provides a technical advantage of large scale displays and offers an artistic difference that may give the large display an organic or random nature to it. Despite movement of all pixels, a clear image may always be resolved by a viewer at a distance, such as a person in a blimp or on the opposite facing side of a stadium.

Although the present invention has been illustrated and described with reference to preferred embodiments and examples thereof, it will be readily apparent to those of ordinary skill in the art that other embodiments and examples may perform similar functions and/or achieve similar results. All such equivalent embodiments and examples are within the spirit and scope of the invention and are intended to be covered by the following claims.

What is claimed is:

1. A radiation-emitting device for illuminating a display sequence from one or more control sources comprising:

a wand;

a radiation-emitting source comprising a plurality of light emitting diodes (LEDs), each of the plurality of LEDs are disposed on an end of the wand and each of the plurality of LEDs comprises a different color; and a control source in the wand, for controlling the display sequence emitted from the radiation-emitting source, wherein the display sequence comprises lighting the plurality of LEDs in a particular combination to achieve a particular color from the plurality of LEDs;

wherein the wand is configured to operate in a personal mode or a receiver mode, the receiver mode comprises the control source receiving external instructions through a receiver disposed on the wand; and wherein, in the receiver mode, the receiver is configured to receive the instructions from a system comprising:

a beam expander coupled to an infrared pulse laser; and a digital control computer communicatively coupled to a beam scanning galvanometer and the infrared pulse laser, wherein the digital control computer transmits controls to the beam scanning galvanometer and the infrared pulse laser to transmit a plurality of data streams to the receiver to control the display sequence.

2. The radiation-emitting device of claim 1, wherein the radiation-emitting device represents one of a plurality of pixels in a crowd-based display comprising a plurality of radiation-emitting devices, and wherein each of the plurality of radiation-emitting device may independently move.

3. The radiation-emitting device of claim 1, further comprising:

a shock sensor.

4. The radiation-emitting device of claim 1, wherein the radiation-emitting source further comprises:

a at least one color high-intensity LED.

5. The radiation-emitting device of claim 1, wherein the radiation-emitting source further comprises:

a blue high-intensity LED;

a red high-intensity LED; and a green high-intensity LED.

6. The radiation-emitting device of claim 1, further comprising:

an infrared high-intensity LED.

7. The radiation-emitting device of claim 1, further comprising:

a diffuser.

8. A radiation-emitting device for illuminating a display sequence from one or more control sources comprising:

a radiation-emitting source comprising a plurality of light emitting diodes (LEDs), each of the plurality of LEDs comprises a different color, wherein the display sequence comprises lighting the plurality of LEDs in a particular combination to achieve a particular color from the plurality of LEDs;

an infrared receiver;

a microprocessor; and a control source for controlling the display sequence emitted from the radiation-emitting source, comprising:

a beam scanning galvanometer, wherein the beam scanning galvanometer scans a plurality of radiation-emitting devices;

an infrared pulse laser;

a beam expander coupled to the infrared pulse laser; and a digital control computer communicatively coupled to the beam scanning galvanometer and the infrared pulse laser, wherein the digital control computer controls the beam scanning galvanometer and the infrared pulse laser to transmit a plurality of data streams to an area covering a plurality of radiation-emitting devices to control the display sequence.

9. A radiation-emitting device for illuminating a display sequence from one or more control sources comprising:

a radiation-emitting source, comprising a plurality of light emitting diodes (LEDs), each of the plurality of LEDs comprises a different color, wherein the display sequence comprises lighting the plurality of LEDs in a particular combination to achieve a particular color from the plurality of LEDs;

a microprocessor;

a control source for controlling the display sequence emitted from the radiation-emitting source, comprising:

an on-board memory storing a display sequence, wherein a first radiation-emitting source is synchronized to other radiation-emitting sources by starting playback of the display sequence at a specific, common point in time, and wherein the on-board memory comprises a pre-programmed instruction set for controlling the radiation-emitting source responsive to a location of the radiation-emitting source; and a mode selection device configured to select a personal mode or a receiver mode, the receiver mode comprises the control source receiving external instructions through a receiver;

wherein, in the receiver mode, the receiver is configured to receive the instructions from a system comprising:

a beam expander coupled to an infrared pulse laser; and a digital control computer communicatively coupled to a beam scanning galvanometer and the infrared pulse laser, wherein the digital control computer transmits controls to the beam scanning galvanometer and the infrared pulse laser to transmit a plurality of data streams to the receiver to control the display sequence.

10. A radiation-emitting device for illuminating a display sequence from one or more control sources comprising:

a radiation-emitting source, comprising a plurality of light emitting diodes (LEDs), each of the plurality of LEDs comprises a different color, wherein the display sequence comprises lighting the plurality of LEDs in a particular combination to achieve a particular color from the plurality of LEDs;

an infrared receiver;

a shock sensor configured to detect physical contact with another object;

a microprocessor;

a control source for controlling the display sequence emitted from the radiation-emitting source, comprising:

a triggering event that results from a first radiation-emitting source coming into direct contact with a second radiation-emitting source, as detected by the shock sensor located in each radiation-emitting source, wherein the radiation-emitting sources thereafter transmit a plurality of data streams to one another, from the first radiation-emitting source to the second radiation-emitting source and from the second radiation-emitting source to the radiation-emitting source, as received by the infrared receiver in each radiation-emitting device; and a mode selection device configured to select a personal mode or a receiver mode, the receiver mode comprises the control source receiving external instructions through a receiver;

wherein, in the receiver mode, the receiver is configured to receive the instructions from a system comprising:

a beam expander coupled to an infrared pulse laser; and a digital control computer communicatively coupled to a beam scanning galvanometer and the infrared pulse laser, wherein the digital control computer transmits controls to the beam scanning galvanometer and the infrared pulse laser to transmit a plurality of data streams to the receiver to control the display sequence.

11. A method of controlling a display sequence emitted from a radiation-emitting device using laser actuation, comprising:

activating a plurality of radiation-emitting devices in a receiver mode, wherein each radiation-emitting device is capable of receiving a plurality of data streams in an infrared receiver located within the radiation-emitting device, wherein each radiation-emitting device comprises a plurality of light emitting diodes (LEDs), each of the plurality of LEDs comprises a different color, and wherein the display sequence comprises lighting the plurality of LEDs in a particular combination to achieve a particular color from the plurality of LEDs;

scanning the plurality of radiation-emitting devices in a display area repeatedly and rapidly with an infrared laser;

transmitting a plurality of data streams originating from a digital control computer to the plurality of radiation-emitting devices in the display area, wherein the transmissions are completed by the infrared laser capable of scanning a plurality of radiation-emitting devices; and displaying dynamically a laser-actuated display sequence from the plurality of radiation-emitting devices based upon the plurality of data streams;

wherein a display sequence is produced at each radiation-emitting device, the display sequence originating at the digital control computer and being transmitted by an infrared laser to the radiation-emitting device; and wherein a plurality of radiation emitting device may be moved independently and still receive the plurality of data streams and display sequences.

* * * * *